US007101314B1

(12) United States Patent
Wang

(10) Patent No.: US 7,101,314 B1
(45) Date of Patent: Sep. 5, 2006

(54) FACIAL WEIGHTS FOR TOTAL FACIAL MUSCLE TONING AND DEVELOPMENT

(76) Inventor: Soledad Wang, 24300 E. 98th St., Broken Arrow, OK (US) 74014

( * ) Notice: Subject to any disclaimer, the term of this patent is extended or adjusted under 35 U.S.C. 154(b) by 446 days.

(21) Appl. No.: 10/672,734

(22) Filed: Sep. 27, 2003

(51) Int. Cl.
*A63B 23/03* (2006.01)
*A63B 21/065* (2006.01)

(52) U.S. Cl. ..... 482/11; 482/93; 482/105

(58) Field of Classification Search ..... 482/10, 482/11, 44, 47, 50, 79, 92, 93, 105, 108, 109, 482/148; 601/37–39; 16/DIG. 8; D21/683; 473/594
See application file for complete search history.

(56) References Cited

U.S. PATENT DOCUMENTS 3,814,428 A * 6/1974 Foley ..... 273/343
4,189,141 A 2/1980 Rooney
4,195,833 A 4/1980 Svendsen
4,280,696 A 7/1981 Roman
4,823,778 A 4/1989 Ewing
5,165,694 A * 11/1992 Kraushaar ..... 273/343
5,465,458 A * 11/1995 Schlager ..... 16/404
5,655,777 A * 8/1997 Neading et al. ..... 473/594
5,938,572 A * 8/1999 Spano ..... 482/105
6,149,557 A * 11/2000 Williams et al. ..... 482/105
6,224,517 B1 * 5/2001 Dereszynski ..... 482/93
6,406,405 B1 6/2002 Chu

* cited by examiner

*Primary Examiner*—Jerome Donnelly
*Assistant Examiner*—Victor K. Hwang
(74) *Attorney, Agent, or Firm*—Molly D. McKay

(57) ABSTRACT

The invention consists of steel-bead weighted facial exercise weights designed in varying shapes, sizes, and weights. The weights are designed so that they are placed over the face providing resistance against the intended group of facial muscles to be developed. The method is designed for total facial muscle toning and development necessitating the use of varying sized, shapes, and weights that maximize the development of intended muscle group to be developed.

16 Claims, 6 Drawing Sheets

FACIAL WEIGHTS FOR TOTAL FACIAL MUSCLE TONING AND DEVELOPMENT

BACKGROUND OF THE INVENTION

Field of Invention

Figure 1:
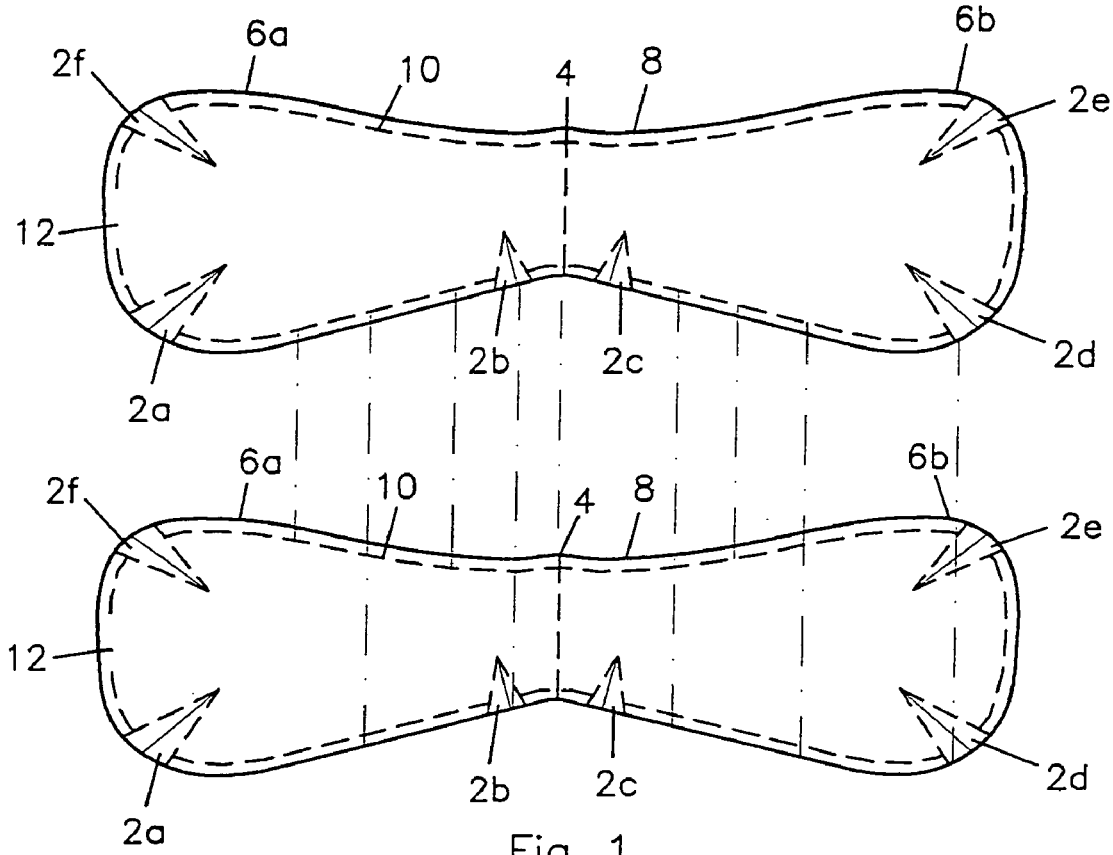

This invention is related to facial weights of varying sizes and shapes designed for total facial muscle toning and development.

BACKGROUND OF THE INVENTION

For centuries efforts have been made to enhance and beautify our facial appearance. There have been developed thousands of creams, gels, toners, and masks with claims of reducing wrinkles and increasing skin tone. Exercise gadgets as well have been designed with the promise of improving ones' appearance. There is cosmetic surgery to remove excessive sagging skin and give the face a tighter more youthful look. This has been favored by the public perhaps because of its immediate observable change. Unfortunately this procedure is costly and leaves the individual with permanent scars. Gadgets and specifically designed facial instruments have been patented for the purpose of facial muscle strengthening, toning, and development. These, however, have not gained popularity for one reason or another. Mainly for the lack of quick results, hassle of assembling the gadgets, public awareness of their availability, or cost factors.

U.S. Pat. No. 4,823,778 to Ewing describes a method of exercising facial muscles by first applying a stiffener to the surface of the skin and attaching weights to the stiffener. The weights are metal discs, the size of a penny arranged in a row. They are encased in thin cardboard plates which are taped together. The individual is to contract facial muscles a predetermined number of times against resistance of this cardboard encased metal discs.

U.S. Pat. No. 6,406,405 to Chu describes a facial muscle exercise device that one places in the mouth with part of the device extending out of the mouth and weighted by steel discs. The gravitational force of the weights put pressure on the part that is held inside the mouth causing one to contract the cheek muscles against this resistance. This contraction will tone specific muscles of the face.

In U.S. Pat. No. 4,189,141, Rooney devised an exercise mask which is convexed and with holes cut out for the eyes, nose, and mouth. It has sewn-in pockets on the underside where lead weights are arranged at specific points. The mask is held in place by head and chin straps. The individual straps on the mask and contracts facial muscles against the resistance of the weights inside the pockets. A plastic liner in between the mask and the face is required to maintain the stretch cloth material clean.

U.S. Pat. No. 4,280,696 to Ramon describes an exercise apparatus consisting of a pair of flat spring arms which are pivotally connected to each other. The individual places this device in between their upper and lower teeth and attempts to squeeze the arms of the device together by pressing the upper and lower teeth together. Squeezing the arms of the device in between the teeth will cause the jaw muscles to contract therefore toning them.

U.S. Pat. No. 4,195,833 to Svendsen describes a method of toning facial muscles by use of a weighted band around the head. The elastic band has fabric encased metal weights that are sewn onto it. This elastic band is placed inside a tubular structure such as a sock. The ends are sewn together to form a circular band. The elastic band is placed over the head with the metal weights over the facial muscles to be worked. The person then contracts facial muscles against resistance of metal disc sewn to the elastic band.

Some of these past developments focus on a particular part of the face (e.g. U.S. Pat. No. 4,195,833 to Svendsen; U.S. Pat. No. 4,280,696 to Roman; and U.S. Pat. No. 6,406,405 to Chu), others may apply to the entire face but lack the diversity of shapes and weights required for full facial development (e.g. U.S. Pat. No. 4,823,778 to Ewing; U.S. Pat. No. 4,189,141 to Rooney).

It is a well known fact that if you want to tone or build muscle you need to work out those muscles you intend to build. To build your upper extremities would require the use of different types of weights. You may use 5 lb barbells to strengthen your wrists or forearms but bench press 60 lbs using free weights for your biceps. The diversity in type and mass of weights to be resisted against is quite different, and this is only for the upper extremities! The face is not all that different when it comes to muscle building. Even though facial muscles are close together, the weight difference required to build muscles around the eyes as opposed to those over the cheeks is significantly different. The shape of the weights used around the eyes should also be of a different conformation than that used, lets say, over the forehead or on the chin. I have designed six flexible weights in different shapes that range from 8 oz (227 gm) to 2.2 lbs (1 kg) that can be used for total facial muscle development, or facial building if you wish. The variable shapes allow weights to be used in specific areas of the face, for example, smaller shaped weights are used around the eyes while the larger ones over the cheeks. The variable fixed sizes (8 oz vs. 2.2 lbs) are advantageous in that you do not need to be adjusting the weight repeatedly with each exercise. Just take the smaller 8 oz weight to use over the eyes and switch to the 2.2 lb elongated weight to work the muscles of the forehead or the cheeks. The special design for use over the eyes, around the eyes, and over the nose bridge is another advantage of this invention. These facial weights are contoured, by addition of pleats, so that there is maximum contact between it and the intended muscle to be developed without the need for adhesives or Velcro.

The weights require no assembly. They are made of an exterior water resistant vinyl fabric, which make them easy to clean, and are weighted with steel beads. The steel beads are an excellent choice for use in weights because of its higher density, requiring less bulky weights and because of its ability to maintain a stable weight despite humidity as compared, for example, to sand. An instructional booklet with illustrations for weight positioning and an exercise routine accompanies the weights.

BACKGROUND OF THE INVENTION

Object and Advantages

Accordingly, besides the objects and advantages of the facial weights described in the above patent, several objects and advantages of the present invention are:

(a) to provide a guided method for proper conditioning, toning, and development of the whole facial muscles in their entirety (b) to facilitate facial workouts by improving ease of use of facial weights (c) to provide exercise weights in variable sizes and shapes that will contour to facial features for maximum contact with facial muscles.

(d) to provide facial weights that are easy to maintain clean (e) to provide facial weights that require no assembly (f) to provide a means by which an individual is able to workout at his own pace in the privacy of his home.

(g) to bring public awareness that facial muscles can be toned and developed just as can any muscle in our bodies via advertisement of facial weights.

(h) to encourage the public to start an exercise routine that includes facial toning and development.

The above are accomplished by means of using individual weighted material filled vinyl covered facial weights designed in varying sizes and shapes and applied over specific facial muscle groups to provide resistance against facial muscle contraction. Twenty facial exercises have been designed for the facial weights.

SUMMARY OF THE INVENTION

The present invention consists of weighted material filled, vinyl covered facial weights of varying sizes and shapes designed to be used directly over the facial muscles to provide resistance against the contracting muscle groups. The varying sizes, shapes, ease of use, and no need for adhesives or assembly offer an advantage in design over previously patented facial weights and apparatus. Weights vary from 8 oz (227 gm) to 2.2 lbs (1 kg). They are designed for a complete facial workout.

Accompanying the facial weights is a booklet with illustrations of 20 exercises designed for total facial muscle toning and development.

BRIEF DESCRIPTION

FIG. 1 is an exploded view of the elongated 1 kg (2.2 lbs) weight. This weight measures 24 cm at its greatest length, 9 cm at the widest part of each wing, and 5 cm at the narrow mid-section. It has six pleats.

Figure 2:
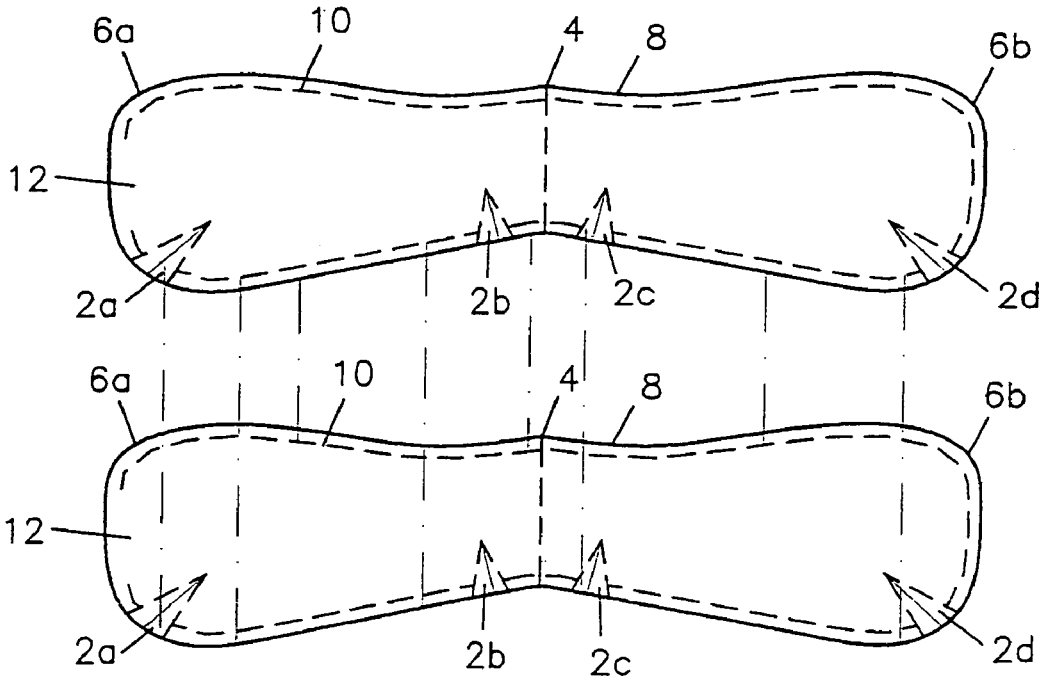

FIG. 2 is an exploded view of the elongated 681 gm (1.5 lbs.) This weight measures 23 cm at its greatest length, 8 cm at the widest part of each wing, and 5 cm at the narrow mid-section. It resembles FIG. 1 except that it has four pleats and its dimensions are smaller.

Figure 3:
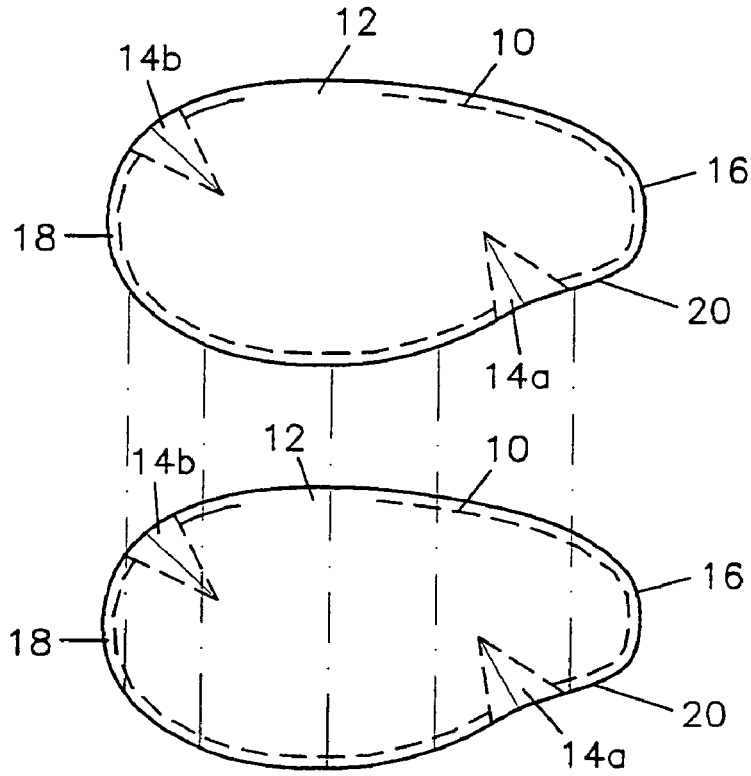
Figure 4:
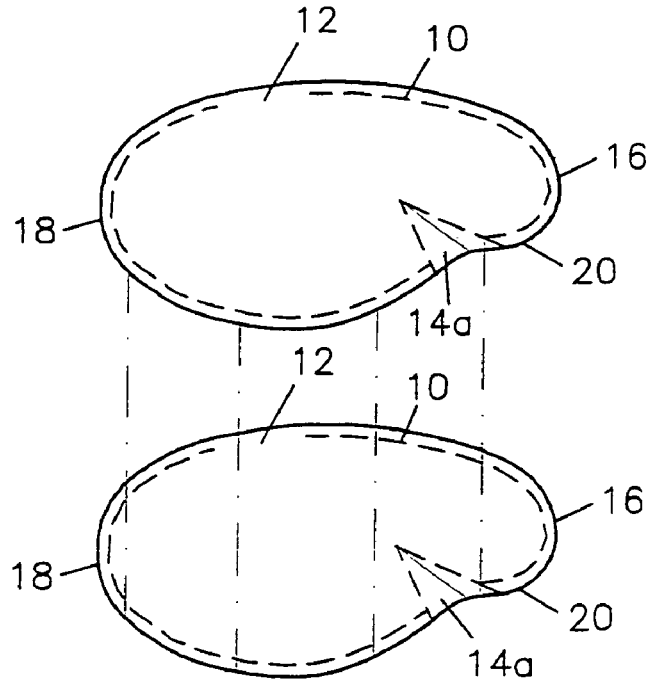

FIG. 3 is an exploded view of the irregular shaped 766 gm (1.8 lbs.) weight. This weight measures 14 cm at its greatest length, 10 cm at its widest part on the base, and 5.5 cm at its widest part on the apex. It has two pleats FIG. 4 is an exploded view of the irregular shaped 454 gm (1.0 lb.) weight. This weight measures 12 cm at its greatest length, 8.5 cm at its widest part on the base, and 5.25 cm at its widest part on the apex. It resembles FIG. 3 except that it has one pleat and is slightly smaller.

Figure 5:
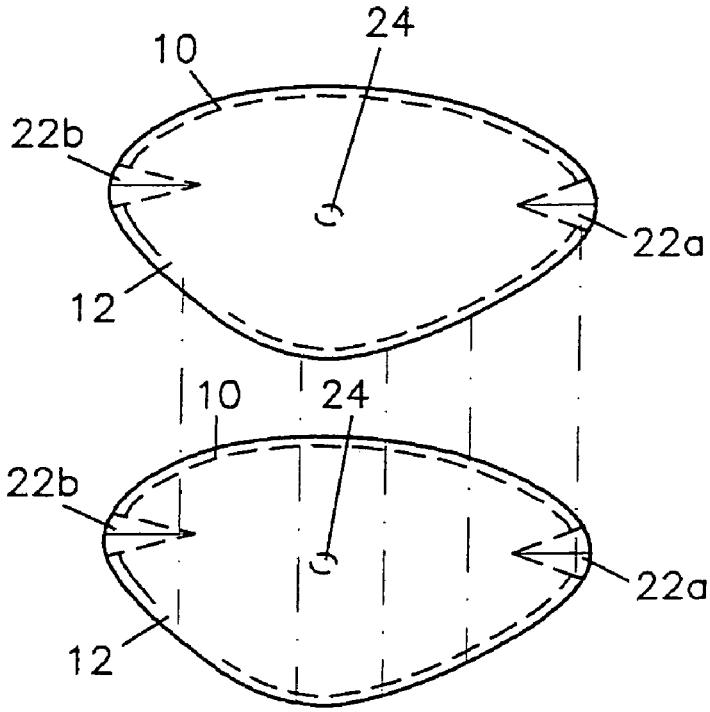

FIG. 5 is an exploded view of the Oculus 284 gm (10 oz) weight. The oculus measures 12.0 cm at its greatest length and 9.0 cm at its widest width. It has a 5 mm circular stitch at its center and has two pleats.

Figure 6:
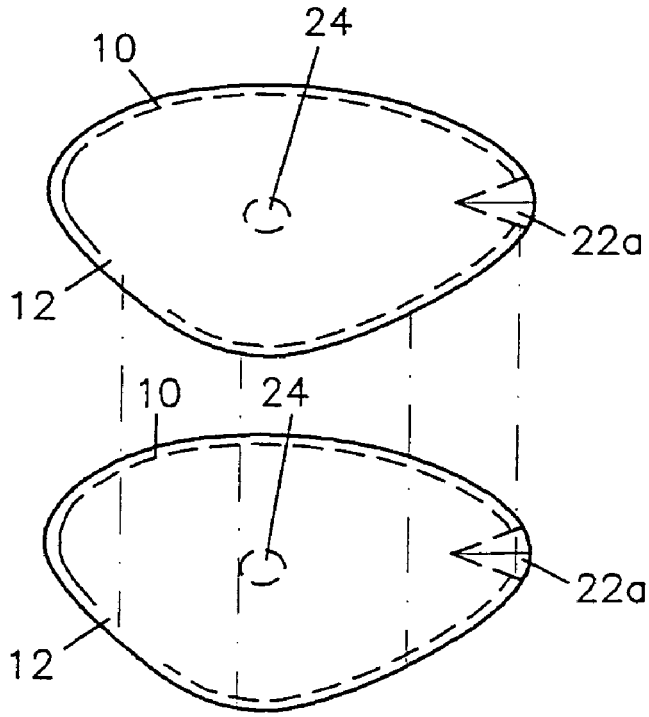

FIG. 6 is an exploded view of the Oculus 227 gm (8 oz) weight. This weight measure 12.0 cm at its greatest length and 9.0 cm at its widest width. It has a 10 mm circular stitch at its center and has one pleat.

FIGS. 7–12 are what the actual finished products look like.

DRAWINGS

Reference Numerals

2*a–f* pleats
4 center straight stitch
6*a–b* the wing part of the weight
8 the neck part of the weight
10 straight stitch at ¼ inch from periphery
12 2.5 cm opening
14*a–b* pleats
16 apex of weight
18 base of weight
20 curve
22*a–b* pleats
24 center stitch

DETAILED DESCRIPTION

Figure 7:
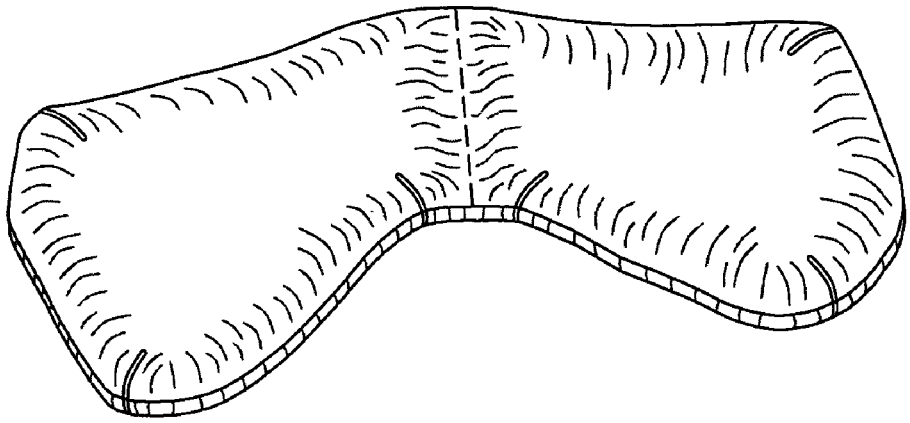

FIGS. 1 and 7:

FIG. 1 depicts two pieces of water-resistant material of identical size and shape. I used vinyl material for the covering. Each piece has six pleats (2*a–f*). First, stitch each pleat along the broken lines as shown in figure one. You will have formed six pleats on each piece of material. Next, place the two pieces of material with outsides surfaces facing each other and match the pleats of one piece to the pleats of the opposite piece of material so that all pleats will line up with each other. Stitch the two pieces together ¼ inch from the periphery as shown by the broken lines (10) leaving a 2.5 cm area without stitching (12). Turn the weight inside out through this opening. Use this opening to fill with a weighted material. I used 1 kg (2.2 lbs) of 4.5 mm steel beads. When you fill the weight with 500 gm (1.1 lbs) of weighted material, stitched the weight with a simple straight stitch (4) at the center as shown in FIG. 1. After this stitch, proceed to fill the other 500 gm. This is a very important step because it will be directly related to good symmetrical development of facial muscles. Once you have filled the weight stitch the 2.5 cm opening closed using an outside straight seam.

FIG. 7 is what the finished product actually looks like.

Figure 8:
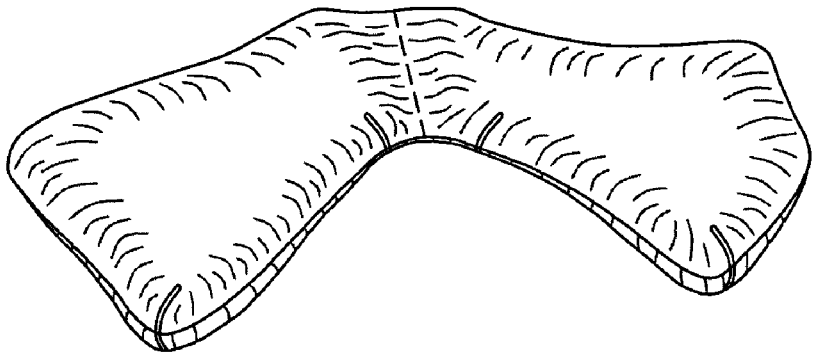

FIGS. 2 and 8:

FIG. 2 depicts two pieces of water resistant material of identical size and shape. For this weight I also chose vinyl. Each piece has four pleats (2*a–d*) as shown in FIG. 2. First stitch each pleat along the broken lines at shown in FIG. 2. Place the two pieces of material together with outside surfaces facing each other and with pleats of one piece matching the pleats of the opposite piece. Stitch along the edge ¼ inch from periphery along the broken lines (10) as shown in FIG. 2 leaving a 2.5 cm area (12) free of stitching. Turn the weight inside out through this 2.5 cm opening. Fill weight with weighted material to 340.5 gm (0.75 lbs), I again used 4.5 mm steel beads. Stitch the center of the weight with a longitudinal outside simple straight stitch (4). Continue to fill the weight with another 340.5 gm (0.75 lbs), of weighted material then stitch the 2.5 cm opening with an outside straight stitch. The two center pleats allow for flexibility.

FIG. 8 is a view of the finished product.

Figure 9:
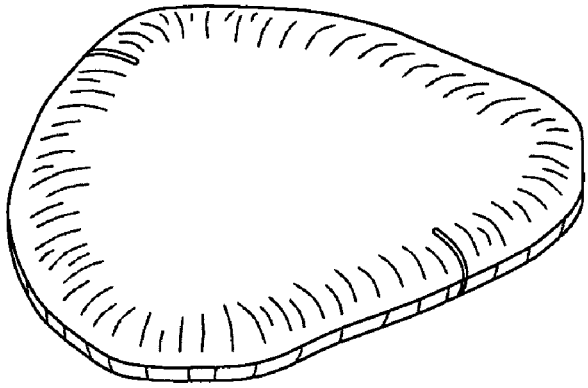

FIGS. 3 and 9:

FIG. 3 depicts two pieces of water resistant material of identical size and shape. For this weight I used a simulated leather, softer in texture than the vinyl because this weight will be used for working muscles close to the eyes. Each piece of material has two pleats. First, stitch each pleat (14*a–b*) along the broken lines as shown in FIG. 3. Next, with outside surface of pieces facing each other stitch ¼ inch along the periphery (10) as shown in FIG. 3 leaving a 2.5 cm area (12) open. Turn the weight inside out through this opening. Fill weight with 766 gm (1.8 lbs) of weighted material. Stitch the 2.5 cm opening with an outside straight stitch.

FIG. 9 is a view of the finished product.

Figure 10:
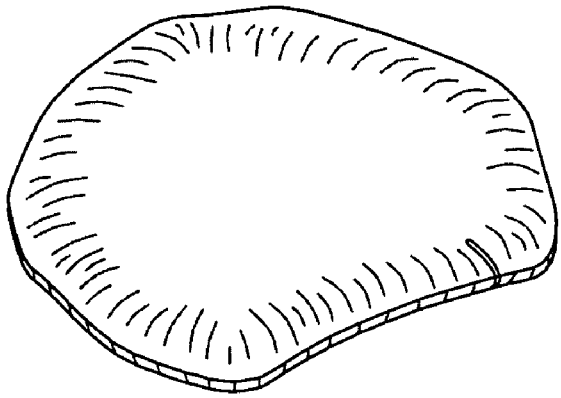

FIGS. 4 and 10:

FIG. 4 shows two pieces of water resistant material of identical size and shape. I used a soft simulated leather. Each piece has one pleat (14*a*). First, stitch each pleat along the broken lines as shown in FIG. 4. Next, place the two pieces of material together with outside surfaces of material facing each other and pleats matching. Stitch around the periphery along the broken lines (10) as shown in FIG. 4 leaving a 2.5 cm opening (12). Turn the weight inside out through this opening. Fill the weight with 454 gm (1 lb) of a weighted material, such as steel beads. After filling the weight, stitch opening with an outside straight stitch.

FIG. 10 is a view of what the finished weight looks like.

Figure 11:
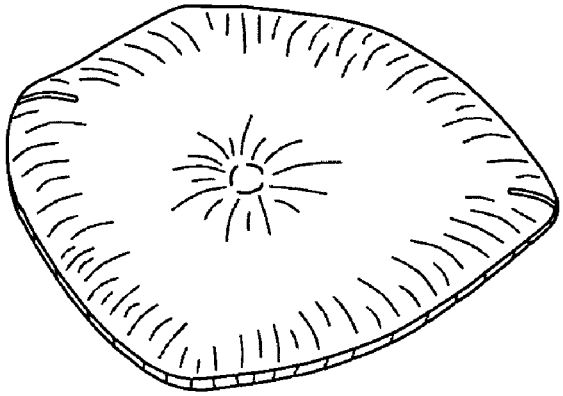

FIGS. 5 and 11:

FIG. 5 depicts two pieces of water resistant material of identical size and shape. For this weight I used a simulated leather because this weight is designed to be used directly over the eye. Each piece of material has two pleats (22*a–b*). First, stitch each pleat along broken lines as depicted on FIG. 5. Next, place the two pieces of material with outside surface facing each other and stitch around the periphery along the broken lines (10) as shown in FIG. 5 leaving a 2.5 cm opening (12). Turn the weight inside out through this opening. Double stitch a 5 mm circle at center of weight (24). This is a crucial step because this stitch will keep the pressure off your eyeball. Fill weight with 284 gm (10 oz) of weighted material. Close opening using an outside straight stitch.

FIG. 11 is a view of the finished product.

Figure 12:
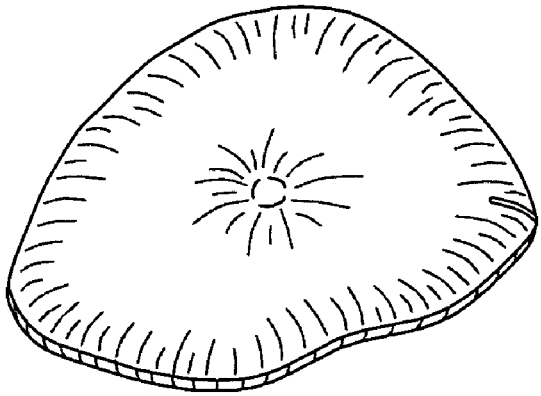

FIGS. 6 and 12:

FIG. 6 depicts two pieces of water resistant material of identical size and shape. I used a simulated leather because this weight is designed to be used directly over the eye. Each piece of material has one pleat (22*a*). First stitch each pleat along the broken lines as depicted on FIG. 6. Next place the two pieces of material with outside surface facing each other and stitch around the periphery along the broken lines (10) as shown in FIG. 6, leaving a 2.5 cm opening. Turn the weight inside out through this opening. Double stitch a 10 mm circle (24) at center of weight. Fill weight with 227 gm (8 oz) of weighted material. Close opening using an outside straight stitch.

FIG. 12 is a view of what the finished weight looks like.

These weights are designed to be used while in the supine position and are designed to be used while performing twenty facial exercises. Those exercises are listed below.

Exercise 1, designed for the 284 gm oculus weight, consists of placing weight over eye, closing eye tightly, and then releasing.

Exercise 2, designed for the 227 gm oculus weight, consists of placing weight over eye, raising eyebrow, and then relaxing it.

Exercise 3, designed for the 454 gm irregular shaped weight, consists of placing weight over temple, closing eye tightly, and then relaxing.

Exercise 4, designed for the 454 gm irregular shaped weight, consists of placing weight below lower eyelid, closing eye tightly, and then relaxing it.

Exercise 5, designed for the 454 gm irregular shaped weight, consists of placing weight as in exercise 4, except raise corner of mouth up toward weight.

Exercise 6, designed for the 766 gm irregular shaped weight, consists of placing weight over cheek and raising corner of mouth toward weight.

Exercise 7, designed for the 766 gm irregular shaped weight, consists of placing weight as in exercise 6 except tighten lips, pucker, and stretch lips away from weight.

Exercise 8, designed for the 766 gm irregular shaped weight, consists of placing weight over cheek but closer to nose and stretching upper lip over top teeth.

Exercise 9, designed for the 766 gm elongated shaped weight, consists of placing weight over higher part of forehead near hairline and lowering eyebrows.

Exercise 10, designed for the 766 gm elongated shaped weight, consists of placing weight over lower part of forehead near brows and raising brows.

Exercise 11, designed for the 766 gm elongated shaped weight, consists of placing weight over bridge of nose with center pleats toward brows and wings over lower half of eyes while tightening eyes, and then relaxing.

Exercise 12, designed for the 766 gm elongated shaped weight, consists of placing weight over bridge of nose with center pleats toward lips and wings over checks, and raise brows.

Exercise 13, designed for the 766 gm elongated shaped weight, consists of placing weight over bridge as for exercise 12 but wrinkle nose and then relax.

Exercise 14, designed for the 1 kg elongated shaped weight, consists of placing weight as in exercise 12, with lips together smile.

Exercise 15, designed for the 1 kg elongated shaped weight, consists of placing weight over bridge of nose as for exercise 12 but move the wings closer to the corner of the mouth, pucker lips, and then relax.

Exercise 16, designed for the 1 kg elongated shaped weight, consists of placing weight as in exercise 15 but stretch upper lip over upper teeth as in exercise 8.

Exercise 17, designed for the 1 kg elongated shaped weight, consists of placing weight between nose and upper lip with center pleats toward nose and wings over cheekbones, and with lips together smile.

Exercise 18, designed for the 1 kg elongated shaped weight, consists of placing weight as in exercise 17 except with center pleats toward chin and wings over cheeks, pucker lips and then relax.

Exercise 19, designed for the 1 kg elongated shaped weight, consists of placing weight as in exercise 18 except that neck is directly over both lips and then pucker lips.

Exercise 20, designed for the 1 kg elongated shaped weight, consists of placing weight as in exercise 19 but over lower lip, and then open and close mouth.

The embodiments of the invention in which an exclusive property or privilege is claims are as defined as follows:

1. A method of toning and developing total facial muscle groups comprising:

contracting facial muscles against resistance provided by means of specifically designed facial weights in varying sizes and shapes, employing twenty specific facial exercises designed for said facial weights consisting of:

a. exercise 1, designed for the 284 gm oculus weight consists of placing weight over eye, closing eye tightly then releasing b. exercise 2, designed for the 227 gm oculus weight consists of placing weight over eye, raising eyebrow then relaxing it c. exercise 3, designed for the 454 gm irregular shaped weight consists of placing weight over temple and closing eye tightly then relaxing d. exercise 4, designed for the 454 gm irregular shaped weight consists of placing weight below lower eyelid, closing eye tight then relaxing it e. exercise 5, designed for the 454 gm irregular shaped weight, consists of placing weight as in exercise 4, except raise corner of mouth up toward weight f. exercise 6, designed for the 766 gm irregular shaped weight consists of placing weight over cheek and raising corner of mouth toward weight g. exercise 7 designed for the 766 gm irregular shaped weight consists of placing weight as in exercise 6 except tighten lips, pucker, and stretch lips away from weight h. exercise 8 designed for the 766 gm irregular shaped weight consists of placing weight over cheek but closer to nose and stretching upper lip over top teeth i. exercise 9 designed for the 766 gm elongated shaped weight consists of placing weight over higher part of forehead near hairline and lowering eyebrows j. exercise 10 designed for the 766 gm elongated shaped weight consists of placing weight over lower part of forehead near brows and raising brows k. exercise 11 designed for the 766 gm elongated shaped weight consists of placing weight over bridge of nose with center pleats toward brows and wings over lower half of eyes while tightening eyes then relaxing l. exercise 12 designed for the 766 gm elongated shaped weight consists of placing weight over bridge of nose with center pleats toward lips and wings over checks, raise brows m. exercise 13 designed for the 766 gm elongated shaped weight consists of placing weight over bridge as for exercise 12 but wrinkle nose and then relax n. exercise 14 designed for the 1 kg elongated shaped weight consists of placing weight as in exercise 12, with lips together smile o. exercise 15 designed for the 1 kg elongated shaped weight consists of placing weight over bridge of nose as for exercise 12 but move the wings closer to the corner of the mouth, pucker lips then relax p. exercise 16 designed for the 1 kg elongated shaped weigh, consists of placing weight as in exercise 15 but stretch upper lip over upper teeth as in exercise 8 q. exercise 17 designed for the 1 kg elongated shaped weight consists of placing weight between nose and upper lip with center pleats toward nose and wings over cheekbones, lips together smile r. exercise 18, designed for the 1 kg elongated shaped weight consists of placing weight as in exercise 17 except with center pleats toward chin and wings over cheeks, pucker lips then relax s. exercise 19, designed for the 1 kg elongated shaped weight consists of placing weight as in exercise 18 except that neck is directly over both lips, pucker lips t. exercise 20, designed for the 1 kg elongated shaped weight consists of placing weight as in exercise 19 but over lower lip, open and close mouth.

2. A set of facial weights for use in facial muscle exercise comprising:

a plurality of flexible facial weights sized and configured to be placed upon and supported by the skin surface of a user's face;

said plurality of flexible facial weights comprising at least one elongated shaped weight having a narrow mid-section and wide ends, and at least one irregular shaped weight having an oval-like shape; and each flexible facial weight comprising a flexible, water resistant external covering and weight material contained within said external covering so that each flexible facial weight is between 227 gm and 1 kg in weight, wherein the plurality of flexible facial weights are selectively placed over various portions of a user's face to provide resistance to exercise of selected muscles of the face.

3. The set of facial weights for use in facial muscle exercise of claim 2, wherein said weight material comprises steel beads.

4. The set of facial weights for use in facial muscle exercise of claim 2, wherein the flexible, water resistant external covering comprises vinyl material.

5. The set of facial weights for use in facial muscle exercise of claim 2, wherein the flexible, water resistant external covering comprises simulated leather material.

6. The set of facial weights for use in facial muscle exercise of claim 2, wherein one of said at least one elongated shaped weights comprises weight material to provide a weight of 1 kg, has a length of approximately 24 cm, a width of approximately 9 cm at its wide ends, and a width of approximately 5 cm at its narrow mid-section.

7. The set of facial weights for use in facial muscle exercise of claim 2, wherein one of said at least one elongated shaped weights comprises weight material to provide a weight of 681 gm, has a length of approximately 23 cm, a width of approximately 8 cm at its wide ends, and a width of approximately 5 cm at its narrow mid-section.

8. The set of facial weights for use in facial muscle exercise of claim 2, wherein one of said at least one irregular weights comprises weight material to provide a weight of 766 gm, a greatest length of approximately 14 cm, a greatest width of approximately 10 cm, and a second width at an apex of approximately 5.5 cm.

9. The set of facial weights for use in facial muscle exercise of claim 2, wherein one of said at least one irregular weights comprises weight material to provide a weight of 454 gm, a greatest length of approximately 12 cm, a greatest width of approximately 8.5 cm, and a second width at an apex of approximately 5.25 cm.

10. The set of facial weights for use in facial muscle exercise of claim 2, wherein one of said at least one irregular weights comprises weight material to provide a weight of 284 gm, a greatest length of approximately 12 cm, a greatest width of approximately 9 cm, and an indentation of approximately 5 mm at its center.

11. The set of facial weights for use in facial muscle exercise of claim 2, wherein one of said at least one irregular weights comprises weight material to provide a weight of 227 gm, a greatest length of approximately 12 cm, a greatest width of approximately 9 cm, and an indentation of approximately 10 mm at its center.

12. The set of facial weights for use in facial muscle exercise of claim 2, wherein said flexible, water resistant external covering for each flexible facial weight comprises two pieces of material of identical size and shape sewn together.

13. The set of facial weights for use in facial muscle exercise of claim 12, wherein said flexible, water resistant external covering of said at least one elongated shaped weights comprises vinyl material.

14. The set of facial weights for use in facial muscle exercise of claim 13, wherein each piece of vinyl material for said at least one elongated shaped weights further comprises 4 to 6 pleats.

15. The set of facial weights for use in facial muscle exercise of claim 12, wherein said flexible, water resistant external covering of said at least one irregular shaped weights comprises simulated leather material.

16. The set of facial weights for use in facial muscle exercise of claim 15, wherein each piece of simulated leather material for said at least one irregular shaped weights further comprises 1 to 2 pleats.

* * * * *